United States Patent [19]

Kokubo et al.

[11] Patent Number: 4,618,302

[45] **Date of Patent: * Oct. 21, 1986**

[54] DEVICE FOR ACCUMULATING AND DELIVERING PAPER SHEETS

[75] Inventors: Eiichi Kokubo; Akira Hirata, both of Tokyo, Japan

[73] Assignee: Laurel Bank Machine Co., Ltd., Tokyo, Japan

[ * ] Notice: The portion of the term of this patent subsequent to Dec. 14, 1999 has been disclaimed.

[21] Appl. No.: 585,029

[22] Filed: Mar. 5, 1984

Related U.S. Application Data

[63] Continuation of Ser. No. 298,585, Sep. 2, 1981, abandoned.

[30] Foreign Application Priority Data

Sep. 4, 1980 [JP] Japan ..... 55-122642

[51] Int. Cl.[4] ..... B65H 29/40

[52] U.S. Cl. ..... 414/33; 271/212; 271/273; 271/314; 271/315; 414/43; 414/93

[58] Field of Search ..... 271/9, 34, 118, 187, 271/198, 272, 273, 274, 314, 315, DIG. 9, 212; 221/176, 252; 194/DIG. 26; 198/624; 414/32, 33, 43, 92, 93, 94

[56] References Cited

U.S. PATENT DOCUMENTS

| | | | |
|---|---|---|---|
| 3,266,799 | 8/1966 | Ingalls | 271/198 X |
| 3,734,490 | 5/1973 | Parks | 271/34 |
| 3,999,749 | 12/1976 | Zambolin et al. | 271/274 X |
| 4,363,584 | 12/1982 | Kokubo | 414/33 |
| 4,423,826 | 1/1984 | Hirata et al. | 271/9 X |
| 4,465,925 | 8/1984 | Goi | 194/DIG. 26 X |

FOREIGN PATENT DOCUMENTS

| | | | |
|---|---|---|---|
| 1238401 | 4/1967 | Fed. Rep. of Germany | 271/198 |
| 122642 | 3/1982 | Japan | 271/315 |
| 1559898 | 1/1980 | United Kingdom | 271/274 |

*Primary Examiner*—Bruce H. Stoner, Jr.
*Assistant Examiner*—Michael P. Gilday
*Attorney, Agent, or Firm*—Fleit, Jacobson, Cohn & Price

[57] ABSTRACT

An apparatus for accumulating and delivering paper sheets for use with a bank note dispenser including a paddle wheel for receiving paper sheets among swirling paddles provided on the paddle wheel and supporting the paper sheets thereon, a scraper for scraping the paper sheets away from the swirling paddles, an alignment plate for aligning the paper sheets above the paddle wheel, and lower and upper delivering rollers for cooperating to deliver, at one time the accumulated paper sheets as a whole in a horizontal direction. The two lower delivery rollers, are raised upwardly to horizontally support the accumulated paper sheets and are rotatably driven to deliver the paper sheets. The two upper delivery rollers are lowered to resiliently clamp the paper sheets between the lower rollers and upper rollers and are rotatably driven to deliver the paper sheets.

3 Claims, 6 Drawing Figures

DEVICE FOR ACCUMULATING AND DELIVERING PAPER SHEETS

This application is a continuation of application Ser. No. 298,585, filed Sept. 2, 1981, now abandoned.

BACKGROUND OF THE INVENTION

1. Field of the Invention

This invention relates to a device for accumulating paper sheets in good order to deliver the thus formed bundle of accumulated paper sheets while holding them firmly so as to prevent the paper sheets from being disturbed.

2. Prior Art

Paper accumulator devices have been widely used, for example, in bank note counting machines and bank note dispensers as the bank note accumulator or in various other types of machines including printing presses and copying machines. The device of this invention has particularly high utility when used in a machine in which different kinds of paper are handled, such as a machine handling bank notes. In order to simplify the description and to facilitate easy understanding of the invention, the following description will be given with particular reference to a bank note accumulator embodying the invention. However, it should be noted here that the device for accumulating and delivering paper sheets according to this invention is not limited to such an application.

A typical example of the conventional bank note accumulator assembled in a bank note counting machine or bank note dispenser installed in a bank is shown in FIG. 1. In this known device shown in FIG. 1, bank notes A fed in-between conveyer belts 1 and kick-up drums 2 are moved in the direction shown by the arrow Z by the action of the rotating drums 2 operatively associated with the conveyer belts 1. After the leading end of each bank note abuts against a stop plate 3, the other or trailing end of the bank note is kicked upwards by the kick-up drums 2. Thus, the bank notes are successively positioned under the already accumulated bank notes.

However, in the accumulator device of the aforementioned type, since the upper face of the bank note moving to the accumulation station contacts the underside of the lowermost bank note already accumulated and held at the accumulation station, the next bank note tends to be caught by the lowermost bank note, causing the paper sheet accumulator assembly to jam or the bank note to be underlaid in an improper state when the lowermost bank note is downwardly folded or has a tear. Moreover, such a trouble is also encountered when handling bank notes made of a soft or flexible material.

SUMMARY OF THE INVENTION

The principal object of this invention is to provide an improved paper sheet accumulator device which is operated reliably to accumulate paper sheets in good order and to deliver a stack of accumulated paper sheets while preventing the same from being disturbed or disordered during the delivery stage.

Another object of this invention is to provide an improved paper sheet accumulator device provided with means for securing reliable delivery of the stack of accumulated paper sheets.

A further object of this invention is to provide an improved paper sheet accumulator device having delivery means capable of accommodating changes in thickness of the stack of accumulated paper sheets.

A still further object of this invention is to provide an improved paper sheet accumulator device having lower and upper rollers which are held in the retracted positions during the paper sheet accumulation operation and moved to the operating positions to resiliently clamp the top and the bottom of the stack of accumulated paper sheets securely while moving in one direction at a synchronized speed to ensure reliable delivery and to prevent disturbance or disorder of the once stacked paper sheets during the later delivery operation.

Yet a further object of this invention is to provide a bank note dispenser provided with the paper sheet accumulator device of the aforementioned kind.

According to the principal aspect of this invention, there is provided an improved device for accumulating paper sheets in good order and for delivering the thus formed stack of accumulated paper sheets while holding the sheets firmly but softly to prevent the stack from being disordered, comprising a paddle wheel disposed downstream of a conveyer assembly for feeding paper sheets and having a plurality of swirling paddles overlapping each other, the paddle wheel being carried by a substantially horizontally extending shaft for rotation to receive paper sheets between the paddles, a scraper disposed adjacent to the periphery of the paddle wheel to scrape the paper sheets away from the swirling paddles, an alignment plate normally held in a substantially vertical direction during the accumulation operation and having a face to be abutted by the leading ends of the paper sheets for aligning the same in good face-to-face order, the alignment plate being swung to a substantially horizontal position to guide the stack of accumulated paper sheets after the completion of accumulation operation and at the initiation of the delivery operation, a lower delivery rollers to be held at a lower retracted position during the accumulation operation and raised to an upper operating position to support the bottom face of the stack of accumulated paper sheets while moving in one direction to deliver the stack to a discharge passage during the delivery operation, and an upper delivery roller-and-belt assembly to be retracted at an upper and substantially horizontal position during the accumulation operation and to be lowered to a lower bent position at the time of initiation of the delivery operation to press resiliently the top of the stacked paper sheets to softly clamp the stack between it and the aforementioned lower delivery roller-and-belt assembly while moving in the same direction as that of the aforementioned lower delivery roller-and-belt assembly to prevent the stack of accumulated paper sheets from being disordered by the delivery operation.

The device of this invention is particularly convenient for use in a bank note dispenser. However, it is not be limited only to use in an apparatus in which bank notes are handled, but may be utilized in various other machines such as printing machines and copying machines, although the following detailed description will be given with reference to a bank note dispenser illustrated in the appended drawings.

DESCRIPTION OF THE DRAWINGS

A full understanding of the objects and advantages of the present invention will be had by reading the following detailed description of the invention with reference to the appended drawings, in which.

DESCRIPTION OF THE PREFERRED EMBODIMENT

A preferred embodiment of this invention will now be described in detail with reference to FIGS. 2 to 6.

Figure 1:
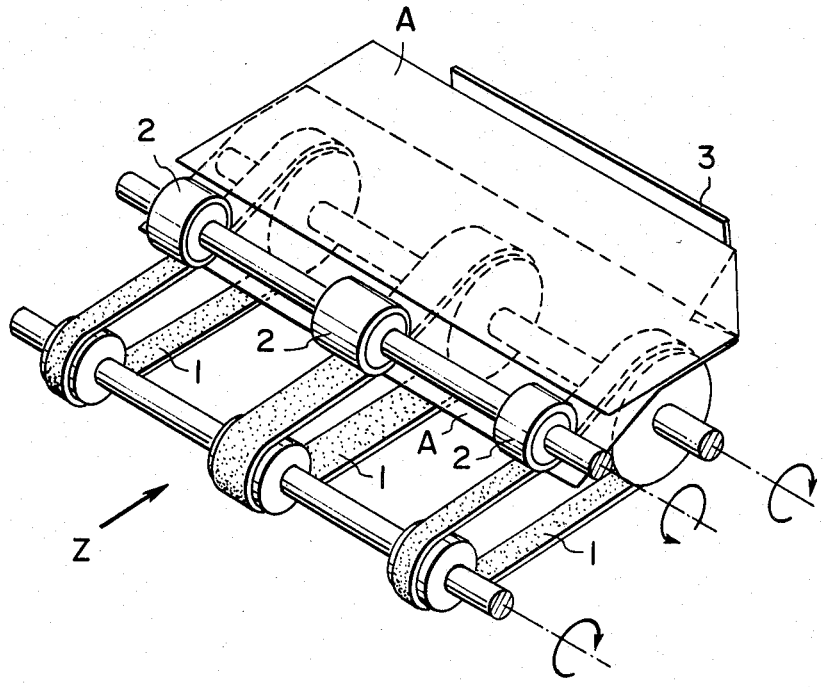
FIG. 1 PRIOR ART
FIG. 1 is a perspective view schematically showing the main portion of a conventional paper sheet accumulator device.
Figure 2:
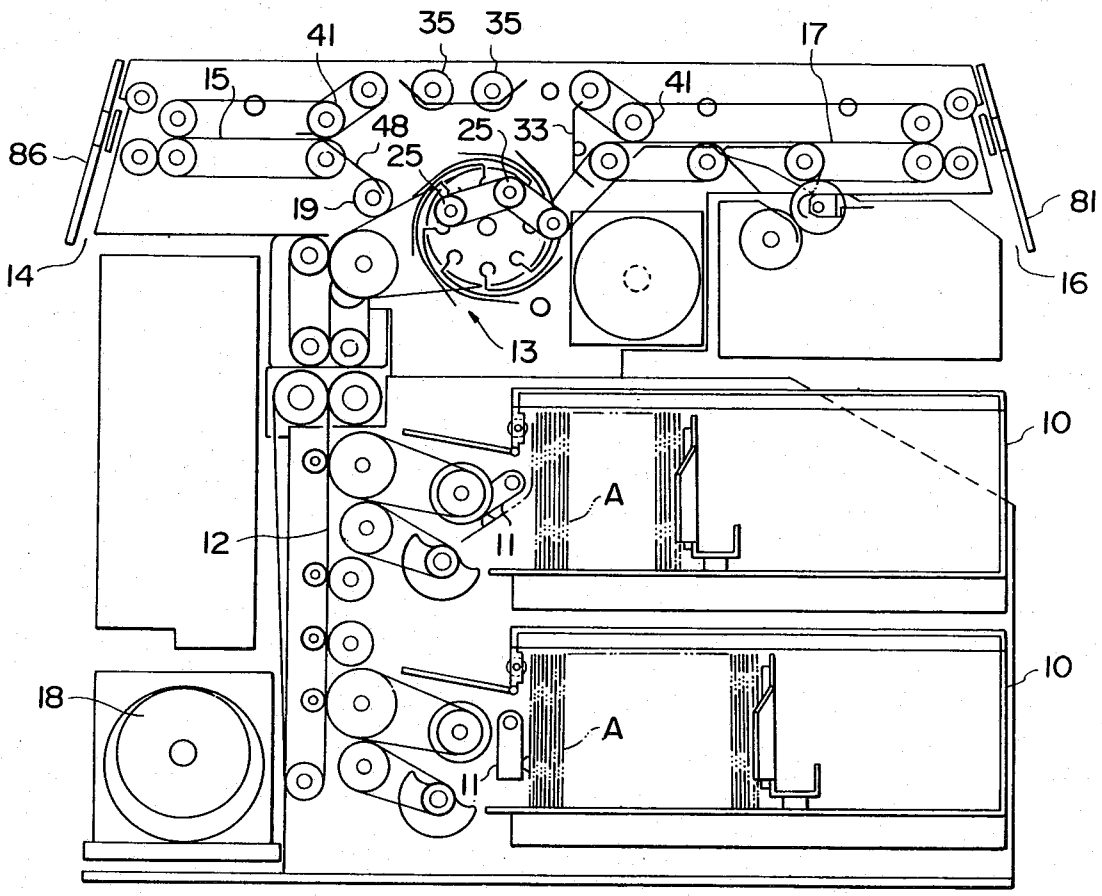
FIG. 2 shows a schematic side elevation of the inside portion of a bank note dispenser incorporated with the paper sheet accumulator device of the invention.

Firstly referring to FIG. 2 showing a schematic side elevation of a bank note dispenser, the dispenser includes bank note stackers 10, 10 releasingly pushed into the dispenser and containing sorted bank notes A. The bank notes A are successively sucked by suction heads 11, 11 one by one from the stackers 10, 10 and passed to a conveyer belt assembly 12. The bank note dispenser further includes a paper sheet accumulator device 13 according to the present invention for accumulating the bank notes A in the form of a stack of bank notes overlapping one another and aligned in good face-to-face order. A first dispensing port 14 opens at one side wall of the housing of the dispenser, and a first discharge conveyer assembly 15 is provided to convey the stack of accumulated bank notes to the first discharge port 14. A second dispensing port 16 opens at the other side wall of the dispenser housing and a second discharge conveyer assembly 17 is provided for conveying the stack of accumulated bank notes to the second dispensing port 16. A driving motor for driving the conveyer belt assembly 12 and the accumulator device 13 is schematically shown by 18.

Figure 3:
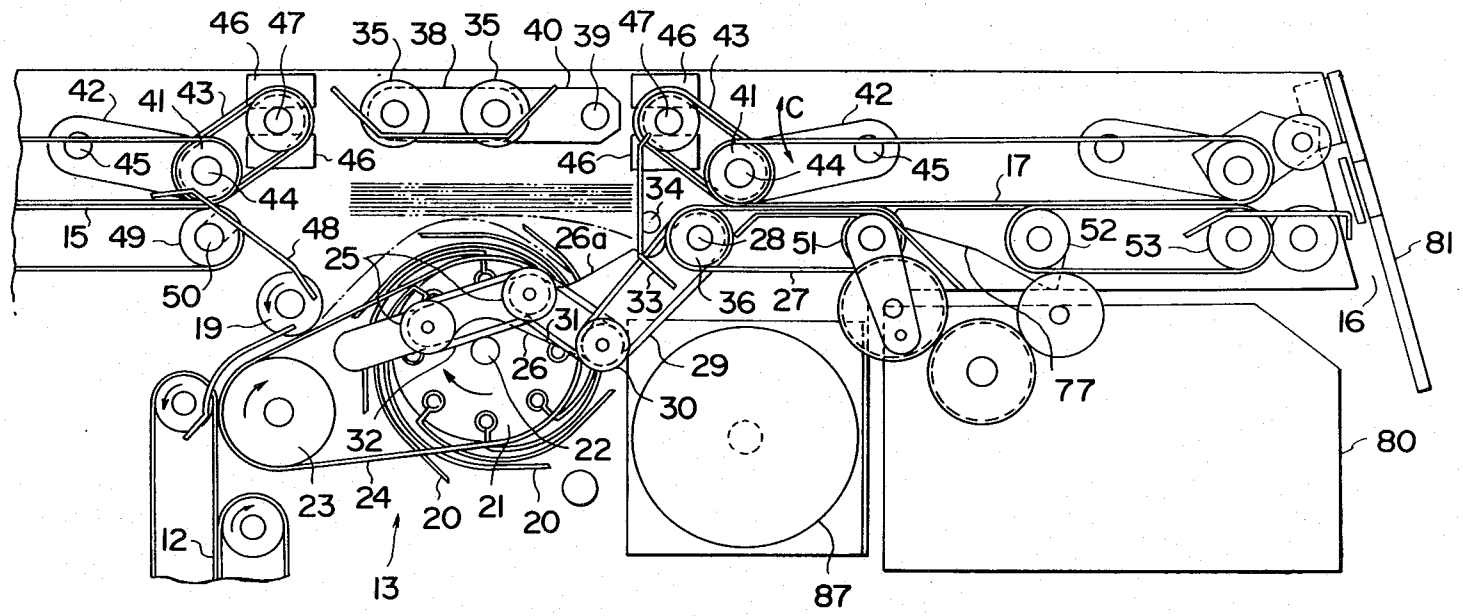
FIG. 3 shows a more detailed side elevation of the paper sheet accumulator device shown in FIG. 2.

The detailed structure of the accumulator device 13 is shown in FIGS. 3 to 6. Referring to FIG. 3, a plurality of swirling paddles 20 are implanted on the periphery of a paddle wheel 21 in overlapping relationship with each other. The paddle wheel 21 is rotatably mounted on a substantially horizontal shaft 22. A belt 24 is trained on the paddle wheel 21 and a roller 23 provided adjacent the upper end portion of the conveyer belt assembly 12 so that the paddle wheel 21 and the roller 23 rotate in the clockwise direction as viewed in FIG. 3. Reference numeral 19 designates a kick-up roller to ensure that the bank notes are firmly and snugly inserted inbetween the paddles 20. Two or more of paddle wheels 21 are mounted on the shaft 22 and spaced from each other.

Figure 4:
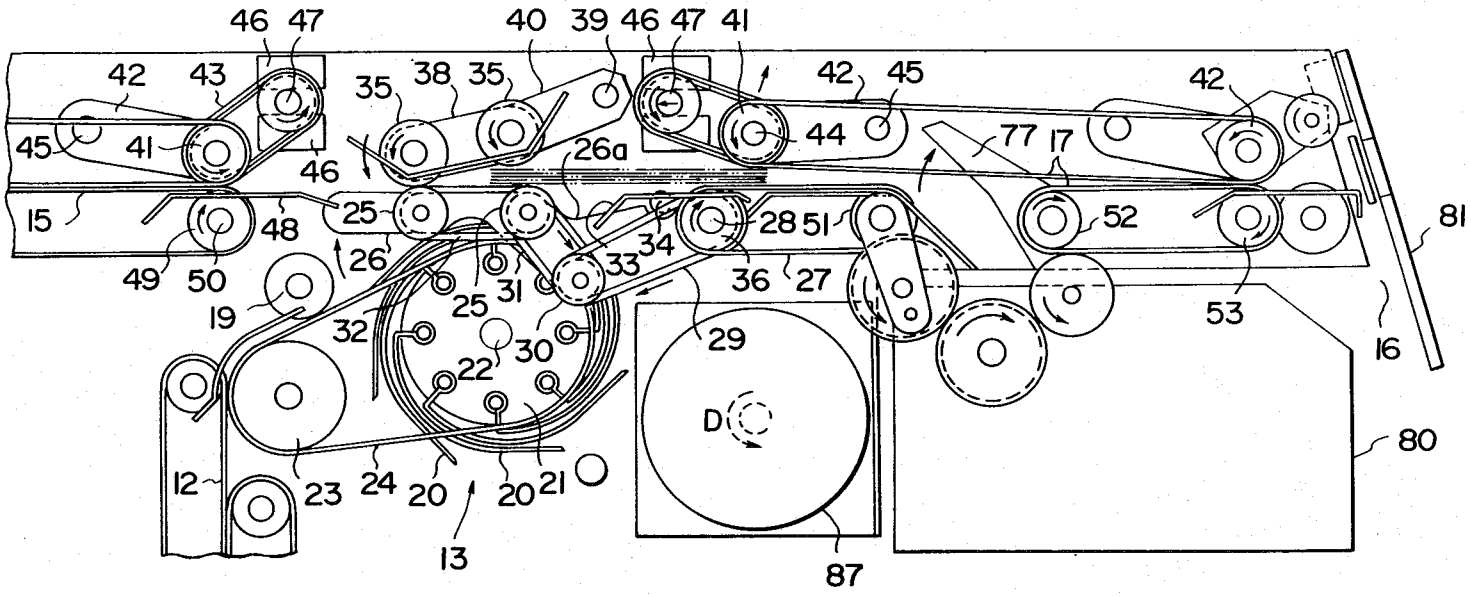
FIG. 4 shows a side elevation of the paper sheet accumulator device similar to FIG. 3, but showing an operational condition different from that shown in FIG. 3.

Lower delivery roller-and-belt assemblies are disposed at a distance from the adjacent paddle wheels and/or at the laterally opposite sides of the shaft 22. Each lower delivery roller-and-belt assembly includes rollers 25, 25 mounted on a zigzag-shaped support arm 26 having its base end secured to a shaft 28 on which a roller 36 for a lower delivery belt 27 is fitted. The lower delivery rollers 25, 25 are rotated through a belt 29, another roller 30 and a belt 31, as the roller 36 is rotated, to move a lower delivery belt 32 trained on the rollers 25, 25. The support arm 26 also has a gently curved side edge portion **26*a* which is positioned adjacent to the periphery of the paddle wheel 21 to form a scraper portion for scraping the bank notes inserted inbetween the paddles 20 from the paddle wheel 21. An alignment plate 33 is swingably mounted on a pivot shaft 34. The alignment plate 33 is held in a vertical position, as shown in FIG. 3 when the bank notes are accumulated. The alignment plate 33 is swung to a horizontal position, as shown in FIG. 4, when the stack of accumulated bank notes is delivered to either one of the first and second discharge conveyer assemblies 15 or 17** so as not to hinder the delivery movement of the stack of bank notes.

Figure 5:
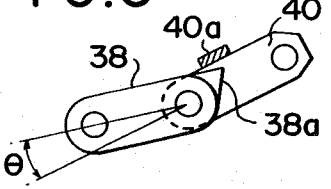
FIG. 5 is a side view showing the arm on which the upper delivery roller assembly is mounted.

Upper delivery rollers 35, 35 are disposed above the paddle wheels 21. These upper delivery rollers 35, 35 are mounted on the opposite ends of an arm 38 which is connected with an arm 40 secured to a pivot shaft 39. This construction is shown in detail in FIG. 5. Referring to FIG. 5, the arm 38 is provided with a protruding lug **38*a* outwardly extending therefrom. The arm 40 has, on the other hand, a limit plate 40*a* for limiting the swinging movement of the arm 38. As the upper edge of the lug 38*a* engages with the limit plate 40*a*, the arm 38 and the arm 40 extend linearly as shown in FIG. 3. By the engagement of the lug 38*a* with the limit plate 40*a*, the arm 38 is prevented from swinging further in the counter-clockwise direction relative to the arm 40. At the delivery stage, the arm 40 is swung downwards about the pivot shaft 39 and, therefore, the arm 38 is also swung downwards as viewed in FIG. 4, so that the arms 38 and 40** are lowered to the lower delivery position.

The upper rollers 41, 41 respectively of the discharge conveyer assemblies 15 and 17 at the input sides are rotatably mounted on one end of link shafts 44 of arms 42 and 43. The other end of the arm 42 is carried by a pivot shaft 45 for rotation. The other end of the arm 43 is carried by a shaft 47 which is slidingly accommodated in a guide slot formed in a guide block 46 and extending substantially parallel to the moving direction of the conveyer belt 15 or 17. With such construction, the upper roller 41 disposed at the input side of the discharge conveyer assemblies 15 and 17 can be lowered or raised in accordance with the thickness of the stack of accumulated bank notes in the direction generally shown by the arrow C in FIG. 4.

Reference numeral 48 designates a guide plate for guiding the stack of bank notes to the discharge conveyer assembly 17. The guide plate 48 is carried by a shaft 50 to which a lower roller 49 at the input side of the discharge conveyer assembly 15 is secured. By the swinging movement of the shaft 50, the guide plate 48 is positioned obliquely, as shown in FIG. 3, so that it does not hinder the bank note accumulating operation. However, the guide plate 48 is moved to the position as shown in FIG. 4 to extend substantially horizontally by the swinging movement of the shaft 50 to guide the stack of bank notes.

A driving motor for actuating the discharge conveyer assemblies 15 and 17 is shown by 87. As the motor 87 rotates in the direction shown by the arrow D in FIG. 4, the rollers 36, 51, 52, 53, 41 and 42 of the discharge conveyer assembly 17 disposed on the side of the second dispensing port 16 are rotated through power transmission means, not shown, and at the same time the belt 32 trained over the lower delivery rollers 25, 25 is moved in the direction as shown by the arrow in FIG.

4. Furthermore, the upper delivery rollers 35, 35 are also rotated in the direction shown by the arrows in FIG. 4. At this time, rollers 41 and 49 of the discharge conveyer assembly 15 disposed on the side of the first dispensing port 14 are rotated in the directions shown by the arrows so that the conveyer belt 15 is moved in the same direction as the conveyer belt 17 to ensure reliable delivery of the stack of accumulated bank notes.

On the other hand, as the driving motor 87 rotates in the direction opposite to the direction shown by the arrow D, the rollers of the discharge conveyer assemblies 15 and 17 are rotated in direction opposite to the arrows illustrated in FIG. 4 and the upper delivery rollers 35, 35 are rotated in the direction opposite to the direction shown by the arrows in FIG. 4, so that the stack of accumulated bank notes is delivered to the discharge conveyer assembly 15 to be dispensed through the first dispensing port 14. Under such operation conditions, the moving direction of the belt 17 is the same as the moving direction of the belt 15 to ensure reliable delivery of the stack of accumulated bank notes to the discharge conveyer assembly 15.

Finally referring to FIG. 6, the structure and operation of a mechanism for moving the arm 26 on which the lower delivery rollers 25 are mounted, for moving the arm 40 on which the upper delivery rollers 35, 35 are mounted, and for moving the alignment plate 33 and the guide plate 48 will be described in detail.

A gear 55 is oscillatorily rotated by a third motor 88 and meshes with another gear 56 mounted on a shaft 57. Two cams 58 and 59 are also mounted on the shaft 57, the one cam 58 being engaged by a cam follower 60 which is mounted on a link 62 pivoted to a pivot shaft 61, and the other cam 59 being engaged by a cam follower 63 which is mounted on a link 64 pivoted on the same pivot shaft 61. In FIG. 6, the cam follower 63 is hidden behind the cam follower 60. The other end of the link 62 is connected to one end of a link 65 through a connection shaft 67, and the other end of the link 65 is connected to one end of a further link 68 having the other end carried by the shaft 28 on which the arm 26 of the lower delivery roller 25 are secured. On the other hand, a bell crank 69 is secured to the pivot shaft 39 on which the arm 40 of the upper delivery roller 35 is secured. A projection 70 projects from the side face of the one arm of the bell crank 69 and engages with a claw portion 68*a* of the link 68. The link 68 is biased downwards by a spring 71, and the bell crank 69 is biased in the counter-clockwise direction by a spring 72.

Figure 6:
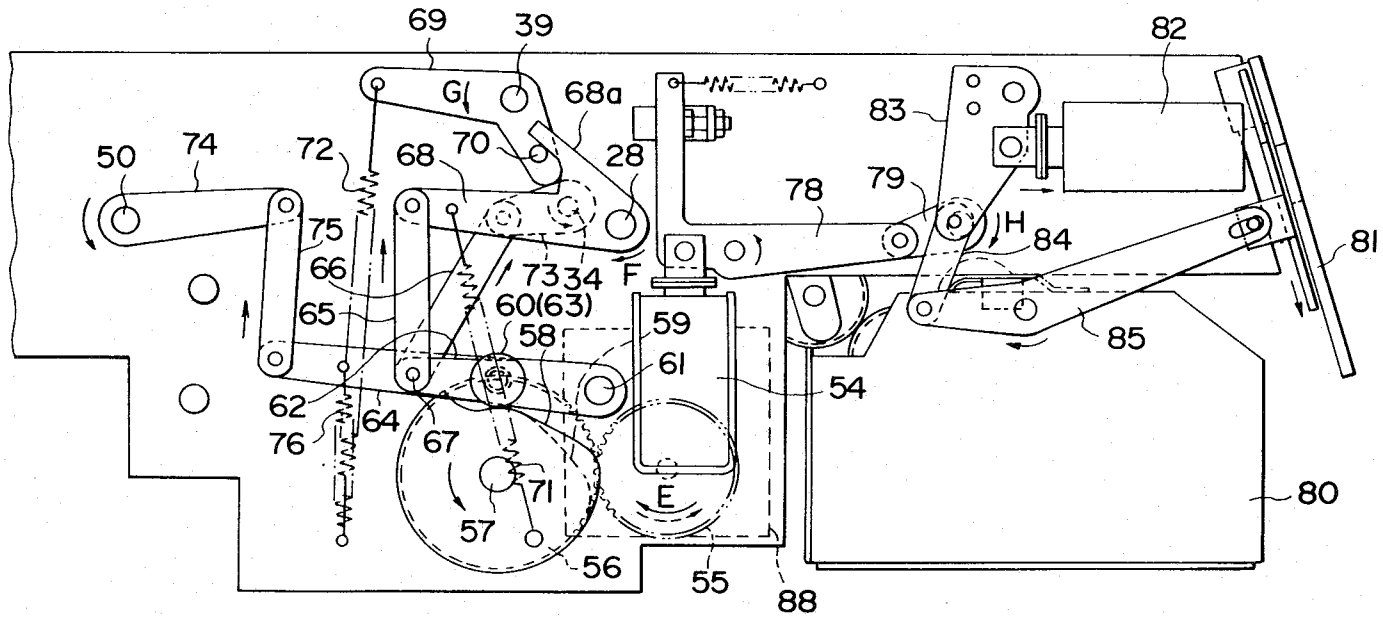
FIG. 6 is a diagrammatical side elevation showing the driving action transmitting mechanism incorporated in the paper sheet accumulator device shown in the preceding Figures.

Another link 66 is connected at the substantial center portion of said link 64, although the connection shaft is overlapped by the connection shaft 67 and hidden thereby, in FIG. 6, and the fore end of the link 64 is connected to one end of a link 75 having the other end connected to one end of a link 74. The other end of the link 74 is carried by the shaft 50 on which the guide plate 48 is carried. The link 66 is connected to a link 73 which is carried by a pivot shaft 34 on which the alignment plate 33 is pivoted. The link 64 is biased in the counter-clockwise direction, as viewed in FIG. 6, by the action of a spring 76.

As the gear 55 is rotated in the direction shown by the arrow E denoted by the solid line, the link 62 is swung in the clockwise direction as viewed in FIG. 6 and the link 62 is rotated in a clockwise direction through the cam 58 and the cam follower 60, whereupon the shaft 28 is rotated in the direction shown by the arrow F by the actions of links 65 and 68 to swing the arm 26 upwards and bring the lower delivery rollers 25, 25 up to the horizontal position as shown in FIG. 4. At the same time, the link 69 is swung in the direction shown by the arrow G by the action of the spring 72 to lower the upper delivery rollers 35, 35 to the positions shown in FIG. 4 so as to hold the stack of accumulated bank notes between the rollers 25, 25 and the rollers 35, 35.

The link 64 is swung in the clockwise direction by the cam 59 and the cam follower 63 to move the links 75 and 74, whereupon the shaft 50 is rotated to move the guide plate 48 in the horizontal position as shown in FIG. 4. The pivot shaft 34 is also rotated by the clockwise swinging movement of the link 64 through the links 66 and 73, whereupon the alignment plate 33 is swung to its horizontal position as shown in FIG. 4.

Reference numeral 54 designates a solenoid for actuating a reject fork 77 (see FIG. 4). The solenoid 54 is energized when a malfunction, such as erroneous counting, is detected, to swing a link 79 in the direction shown by the arrow H via another link 78 to erect the reject form 77 as shown in FIG. 4 to guide the stack of accumulated bank notes moved by the discharge conveyer belt 17 collectively into a reject box 80.

Reference numeral 81 designates a shutter plate which is opened and closed by links 83, 84 and 85 actuated by a shutter solenoid 82 to open or close the second dispensing port 16. A similar mechanism is provided to actuate the shutter 86 at the first dispensing port 14.

The operation of the paper sheet accumulator device of the present invention will now be described with reference to the illustrated embodiment.

One of the bank notes A contained in the stackers 10 is sucked by a suction head 11 to be passed to the conveyer belt assembly 12 and moved upwards. The bank note is then inserted inbetween the paddles 20 by the action of the kick-up roller 19 and the belt 24. In this accumulating operation, the lower delivery rollers 25, 25, the upper delivery rollers 35, 35, the alignment plate 33, the guide plate 48 and the input side upper rollers 41, 41 are held at the positions shown in FIG. 3. The bank note inserted between the paddle 20 of the paddle wheel 21 is rotated with the rotation of the paddle wheel 21 until its leading end abuts against the scraper portion 26*a* of the arm 26. The bank note is stopped when its leading end engages with the scraper portion 26*a* of the arm 26, and withdrawn from the paddles 20. Then, the bank note is pushed up by the rotating paddle wheel 21 while having its leading end engaged with the alignment plate 33 to be held above the paddle wheel 21 during the accumulation operation. The subsequent bank notes are successively fed below the preceding bank notes by the paddle wheel 21 and accumulated in good face-to-face order above the wheel 21, with the leading ends of the bank notes being aligned by the alignment plate 33. Although a detailed description will not given herein, a signal is generated when instructed numbers of designated kinds of bank notes have been accumulated. In response to this signal, the gear 55 is rotated in the direction shown by the solid line F in FIG. 6 by about a half revolution so that the shaft 28 integrally connected with the link 68 is rotated in the clockwise direction, as viewed in FIG. 6, by the actions of the cam 58, cam follower 60 and links 62 and 65. As the shaft 28 rotates, the arm 26 is swung to move the lower delivery rollers 25, 25 to the horizontal position as shown in FIG. 4. At the same time, the projection 70 of the bell crank 69 is released from the claw portion 68*a* of the link 68 so that the bell crank 69 is swung in the counter-clockwise direction to rotate the shaft 39 also in the counter-clockwise direction by the biasing force of the spring 72, whereby the arm 40 is swung to lower the upper delivery rollers 35, 35 to resiliently hold the stack of bank notes.

Concurrently, the shaft 50 fixedly secured to the link 74 is rotated in the counter-closkwise direction by about 45 degrees through the cam 59, the cam follower 63, and the links 64 and 75 to locate the guide plate 48 at the substantially horizontal position as shown in FIG. 4, and the pivot shaft 34 fixedly secured to the link 74 is rotated in the clockwise direction by about 90 degrees by the action of said link 64 and through the link 66 so that the alignment plate 33 is swung to the horizontal position as shown in FIG. 4. Subsequently, the driving motor 87 is actuated to move the discharge conveyer belt assemblies 15 and 17, through a transmission mechanism (not shown), for example, in the direction toward the second dispensing port 16. At this time, the lower delivery rollers 25, 25 are rotated by the roller 36 via the belt 29, the roller 30 and the belt 31 to move the belt 32 in the direction toward the second dispensing port 16, so that the stack of bank notes accumulated above the paddel wheel 21 is moved toward the second dispensing port 16. During such operation, the alignment plate held at the horizontal position serves to guide the moving stack of bank notes. The upper roller 41 at input side can be swung about the fixed axis 45 to be raised in accordance with the thickness of the stack of accumulated bank notes. Referring to FIG. 4, the rejection fork 77 is shown as being erected, this being the operation when any trouble such as erroneous counting is sensed. In such a case, the stack of accumulated bank notes is stopped by the reject fork 77 and guided to the reject box 80 collectively. In normal operation, the reject fork is not erected and the stack of bank notes is discharged by the discharge conveyer belt 17 to the second dispensing port 16 and the shutter 81 is opened.

When it is desired to dispense the stack of accumulated bank notes from the first dispensing port 14, the driving motor 87 is rotated in the direction opposite to that described above to move the discharge conveyer belts 15 and 17 in the direction from the right to the left as viewed in FIGS. 3 and 4 to discharge the stack of bank notes from the first dispensing port 14.

Although the scraper portion 26*a* forms a portion of the arm 26 in the illustrated embodiment, a separate scraper plate may be provided, or a portion of the alignment plate 33 may be used as the scraper.

Similarly, many modifications and changes can be contemplated by those skilled in the art without departing from the spirit and scope of this invention. The illustrated embodiment is therefore to be considered as not restrictive, the scope of the invention being indicated by the appended claims rather than by the foregoing description, and all changes which come within the meaning and range of equivalency of the claims are therefore intended to be embraced therein.

What is claimed is:

1. An apparatus for accumulating and delivering paper sheets to a plurality of conveyor belts for use with a bank note dispenser, said apparatus comprising:

a paddle wheel rotatably mounted on a horizontal shaft, said paddle wheel being provided with a plurality of swirling paddles for receiving paper sheets therebetween;

a scraper disposed adjacent the periphery of said paddle wheel to scrape the paper sheets away from said swirling paddles;

an alignment plate adapted to be held vertically during the accumulating operation to engage with the paper sheets at the leading ends thereof for aligning the paper sheets above the paddle wheel;

lower and upper delivery roller means cooperating to deliver, at one time, the accumulated paper sheets as a whole above the paddle wheel in a horizontal direction;

said lower delivery roller means comprising a pair of lower rollers adapted to be raised upwardly to horizontally support the accumulated paper sheets thereon and to be rotatably driven for delivery of the paper sheets, and the axis of each said lower roller being spaced from each other; and said upper delivery roller means comprising a pair of upper rollers adapted to be lowered downwardly to resiliently clamp the paper sheets between the pair of the lower rollers and the pair of the upper rollers and to be rotatably driven for delivery of the paper sheets.

2. An apparatus according to claim 1, further comprising at least one auxiliary delivery roller means disposed downstream of the accumulating station where the paper sheets are accumulated and including one roller adapted to be vertically moved and lowered to engage with the paper sheets for delivering said sheets during the delivery operation.

3. An apparatus according to claim 1, wherein said lower and upper delivery roller means are operatively associated with each other by a link means, adapted to move said lower and upper delivery means between the retracted positions and the operating positions in synchronism with each other.

* * * * *